United States Patent [19]

Ardell et al.

[11] 4,200,479

[45] Apr. 29, 1980

[54] METHOD OF MAKING A HOCKEY STICK

[75] Inventors: William E. Ardell, Barrie; William A. Burchmore, Candiac; Leo P. Drolet; Michel Drolet, both of Sherbrooke, all of Canada

[73] Assignee: La Corporation Inglasco Ltee, Sherbrooke, Canada

[21] Appl. No.: 880,798

[22] Filed: Feb. 24, 1978

Related U.S. Application Data

[62] Division of Ser. No. 668,742, Mar. 19, 1976, Pat. No. 4,159,114.

[30] Foreign Application Priority Data

Mar. 12, 1976 [CA] Canada ..... 248349

[51] Int. Cl.[2] ..... A63B 59/14; B32B 31/20

[52] U.S. Cl. ..... 156/154; 144/317; 156/172; 156/257; 156/288; 156/293; 273/67 A; 273/80.3; 273/DIG. 7; 273/DIG. 23

[58] Field of Search ..... 156/257, 288, 298, 293, 156/154, 172, 196; 273/67 A, 73 J, 80 B, 80.3, 67 R, DIG. 7, DIG. 23; 144/317

[56] References Cited

U.S. PATENT DOCUMENTS

| | | | |
|---|---|---|---|
| 1,531,983 | 3/1925 | Sawyer | 156/257 |
| 2,669,279 | 2/1954 | Barter | 156/288 |
| 3,353,826 | 11/1967 | Traverse | 273/67 A |
| 3,533,623 | 10/1970 | Dumont | 273/67 A |
| 3,972,529 | 8/1976 | McNeil | 273/80 B |
| 4,052,499 | 10/1977 | Goupil et al. | 273/67 A |

FOREIGN PATENT DOCUMENTS

| | | | |
|---|---|---|---|
| 471689 | 2/1951 | Canada | 273/67 A |
| 90729 | 1/1958 | Norway | 273/67 A |

*Primary Examiner*—Michael G. Wityshyn

*Attorney, Agent, or Firm*—Larson, Taylor and Hinds

[57] ABSTRACT

This specification discloses an improved ice hockey stick in which strips of reinforcing plastic material disposed in preferably embedded into the wide side surfaces of the handle of an ice hockey stick which otherwise is made of suitable hardwood.

The construction is such that the completed hockey stick handle will be perceived by the hockey player as a conventional wooden hockey stick and not as a hockey stick whose handle is made of plastic or is covered with plastic material.

An improved method for making handles for hockey sticks is disclosed wherein the reinforcing strips are applied to a large number of handle components which are pressed together in a suitable apparatus before installation of the blades to the lower extremity of the handle component.

6 Claims, 16 Drawing Figures

METHOD OF MAKING A HOCKEY STICK

Figures 1, 2, 3, 4, 5, 6, 7, 8, 9, 10:
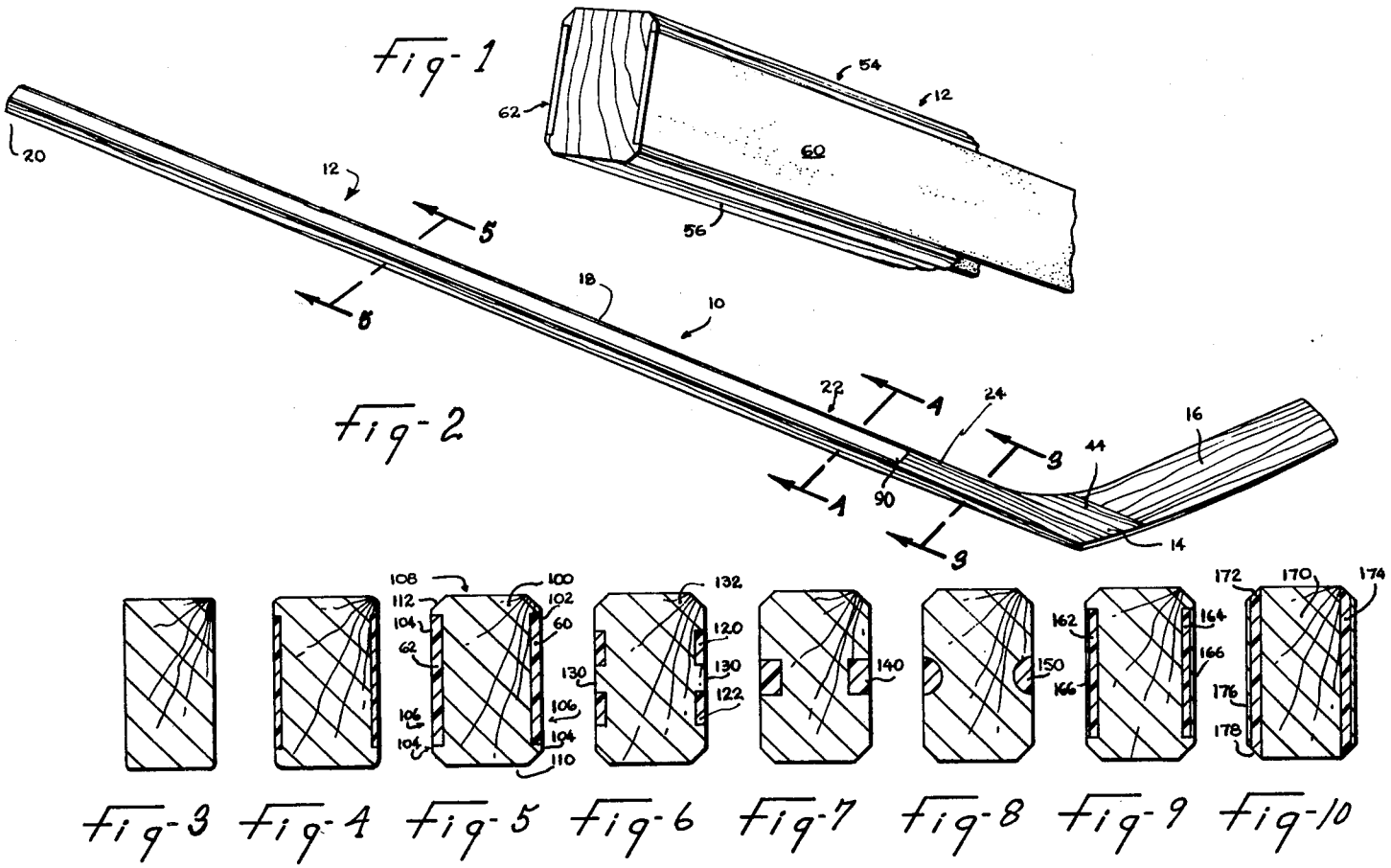

This is a division of application Ser. No. 668,742, filed Mar. 19, 1976, now U.S. Pat. No. 4,159,114.

This invention relates to hockey sticks such as used for playing ice hockey, and more particularly to ice hockey sticks made primarily of wood and designed to be used by skilled hockey players including those playing in senior amateur and professional leagues.

Good hockey sticks are made of hardwood and consist essentially of two elements, namely an elongated handle component and a blade secured to the lower end of the handle component. The handle component with the blade attached are then further fabricated to the final shape. In the final shape the handle component now forms the handle itself and below that a shank portion which is of gradually reducing cross-section and which terminates at a heel portion. The blade is secured to the handle component by glue and it is now common to reinforce the joint with a fiberglass ribbon which is wound around the heel portion of the hockey stick and secured thereto by a suitable adhesive, normally as epoxy glue.

Various attempts have been made in the past to replace wood by another material such as aluminum, fiberglass or combinations of these materials. However hockey players prefer wood and consequently the only suitable material for making ice hockey sticks remains high quality hardwood. Some types of hardwood currently used for making hockey sticks are white ash, hickory and rock elm and only a small percentage of the wood in any given tree will have the desired combination of lightness and stiffness and grain uniformity to be usable for making high quality hockey sticks. In fact normally only about 5% to 10% of a given tree yield will be adequate for making good quality hockey sticks, the rest of the wood being either too heavy or too soft and in some cases too brittle. These restrictions are imposed upon the manufacturers by the hockey players who gradually change their style to one where the hockey stick is subjected to ever increasing impact forces when shooting the puck with a violent hit known as the slap shot. It is therefore becoming increasingly difficult to produce a hockey stick which will be light enough and strong enough for the majority of professional hockey players and in the case of the stronger hockey players it is becoming increasingly difficult to supply a hockey stick which will last even only one complete hockey game.

The difficulty is compounded by the fact that the amount of high quality hardwood suitable for producing hockey sticks becomes more and more limited and this increases the costs of the raw material which is very substantial in relation to the overall costs of production.

Hockey stick handles made of laminated hardwood have therefore been developed but the higher quality laminated hockey stick handles must be made of very thin laminations and are accordingly very costly.

In the recent years a composite hockey stick construction was developed wherein an ordinary hardwood hockey stick is produced after which thin layers of reinforcing material such as fiberglass are glued over each side of the hockey handle and shank portion and in some cases the sheets of fiberglass extend partly or completely over the length of the blade. Such plastic covered hockey sticks however are relatively expensive in that the plastic coverings must be applied on each hockey stick individually, the shank portion tends to be overly rigid with the result that the shocks tend to be transmitted to the arms of the hockey player, and the handle of the hockey stick is no longer perceived by the hockey player as a wooden handle. Consequently the above described plastic covered hockey sticks are not always considered as an improved substitute for good hardwood hockey sticks.

We have found that a vastly improved hockey stick can be produced by using a hockey stick handle component wherein lateral strips of reinforcing inextensible material are disposed in preferably embedded into the wide side surfaces of the handle component and extending from the free extremity of the handle component throughout most of the length of the handle component so that in the final fabricated hockey stick the strips extend for the full length of the handle and into the shank portion but terminate short of the heel portion of the hockey stick.

We have also discovered that this method of production permits the use of hardwood being solid or laminated of less than top grade to produce very high quality hockey sticks at reduced costs.

It is therefore an object of the invention to produce a wooden type ice hockey stick which will meet the most demanding requirements, and which can be mass produced at a reasonable cost.

Another object is to provide a reinforced hockey stick handle which will be perceived by the hockey player as an essentially wooden hockey stick handle.

A further object of the invention is to provide a method for manufacturing hockey stick handles on a mass production basis.

In accordance with this invention we provide a ice hockey stick which consists of a handle, a blade and a shank extending from the handle to the heel for connecting the blade to the handle, the handle and the shank being integrally formed from a single wooden handle component whereas the blade, being made of solid hardwood, is connected to the lower end portion of the handle component by gluing. The wooden handle component is elongated and straight and its cross-section is essentially rectangular and uniform throughout the handle and in the final hockey stick it then gradually reduces in cross-section forming the shank from the lower end of the handle to the region of connection with the blade terminating at a heel portion. The wooden component has throughout the length of the handle two opposite wide side surfaces, a top narrow surface and a bottom narrow surface. The wooden handle component comprises at each wide side surface an inextensible reinforcing rigid strip of constant cross-section made of longitudinally aligned fibres bonded together. Each strip is embedded into a correspondingly shaped groove into the wooden handle component extending throughout the length of the handle and into the portion of the handle component which will form the shank in the finished hockey stick. Each reinforcing strip is flush with the associated side surface, is permanently secured to the wooden handle component by suitable adhesive, is located centrally of the associated wide side surface, and is at least slightly narrower than the associated side surface. The bottom of each groove is at a constant distance from the bottom of the opposite groove which constant distance corresponds essentially to the distance between the wide side surfaces of the wooden handle component in the upper region of the shank.

A ice hockey stick is also produced wherein each strip is relatively wide and thin being of constant rectangular cross-section. Alternatively each strip consists of two spaced apart narrow strip members disposed in respective parallel grooves located inwardly of the corner surfaces.

In a different embodiment each strip is of rectangular cross-section and is disposed in a relatively narrow groove located in the middle of the associated wide surface throughout the length of the handle and partly into the shank.

In a still different embodiment of the invention, the groove for each strip of reinforcing material is deeper than the thickness of the associated strip which is ultimately covered with a thin layer of wooden material and consequently the reinforcing material is completely hidden in the handle portion of the hockey stick handle component.

In still another different embodiment, the hockey stick handle component is made of a relatively thin wooden component whose opposite wide surfaces are covered with a layer of reinforcing material which in turn are covered with a further thin layer of wood, the assembly being held together by suitable adhesive.

The invention also provides a method of making a wooden component to be used in the manufacture of hockey sticks which comprises the steps of making at least one shallow groove of constant cross-section in each wide side surface of an elongated piece of hardwood of constant rectangular cross-section and whose four corners are defined by narrow surfaces cut at 45 degrees inserting into each groove a conforming strip of glass-fiber material whose mating surfaces are coated with a suitable adhesive, and pressing the strips into their respective grooves until substantial curing of the adhesive.

Figures 11, 12, 13, 14, 15, 16:
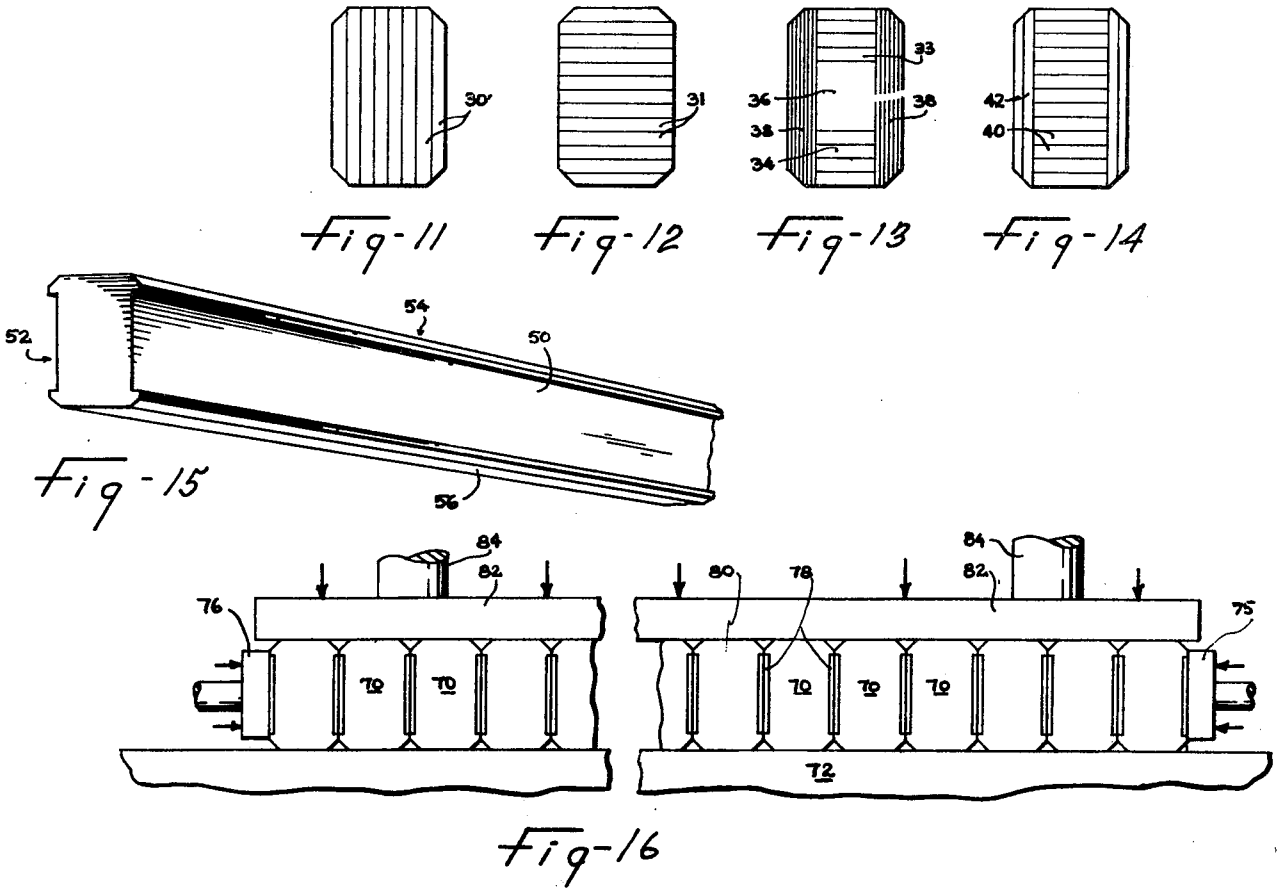

Examplary embodiments of this invention will now be described in details with reference to the accompanying drawings in which:

FIG. 1 is an oblique view of the upper end portion of a hockey stick handle, FIG. 2 is a perspective view in reduced scale of a ice hockey stick, FIGS. 3, 4 and 5 are cross-sectional views respectively taken along lines 3—3, 4—4, and 5—5 in FIG. 2, FIGS. 6, 7, 8, 9 and 10 are cross-sectional views corresponding to the cross-section at line 5—5 in FIG. 2 but relating to different embodiments, FIGS. 11, 12, 13 and 14 are cross-sectional views of different constructions of laminated hockey stick handles, FIG. 15 is an oblique view showing a free end of a grooved handle component, and FIG. 16 is a front elevated view of a plurality of handle components into a press.

In FIGS. 1 and 2 a ice hockey stick is illustrated, particularly in FIG. 2 at reference numeral 10 as consisting of a handle component 12 made essentially of hardwood and including a handle 18, a shank portion 24 to which a blade 16 is attached and terminating into a heel portion 14. Blade 16 is normally made of solid hardwood as a one piece component although in certain cases it may be made of two or more pieces glued together. The inner end of blade 16 is of reduced cross-section and fits into a slot in the shank portion 24 of the handle component and a high quality wood glue is used for retaining the blade 16 thereto. In the illustration of FIG. 2 the details of the connection of the blade to the handle component 12 have been omitted because this is conventional in the art of hockey stick construction and is not part of the present invention.

The handle component 12 defines a handle 18 which extends from the upper free end of handle component 12 as shown at reference numeral 20 down to the region identified by reference numeral 22 which shows the beginning of shank portion 24 which terminates into heel portion 14.

Handle component 12 after fabrication into the final shape of FIG. 2 is a straight elongated piece of hardwood of rectangular cross-section and the exact cross-sections are shown in greater detail in FIGS. 3, 4 and 5 which are respectively taken along lines 3—3, 4—4, and 5—5 shown in FIG. 2. The cross-section of handle component 12 is constant throughout the handle and as can be seen from a comparison of FIGS. 2, 3, 4 and 5, it gradually reduces throughout the shank region 24 i.e., from region 22 to the heel portion 14. Good quality hardwood is used for constructing ice hockey sticks and the preferred solid hardwood materials are white ash, hickory and rock elm. Handle components can also be made of various types of laminates and FIGS. 11, 12, 13 and 14 illustrate in cross-sectional views corresponding to that of FIG. 5 four different lamination constructions which are currently available for making handles for hockey sticks. In FIG. 11 the laminations 30 are relatively thick and made of hardwood and disposed in the vertical plane. The laminations 31 in FIG. 12 are disposed in the horizontal plane and are also made of relatively thick hardwood laminates. FIG. 13 shows a hollow core box lamination consisting of two groups of softwood thick laminations 33 and 34 stacked horizontally into two spaced apart groups leaving a hollow space 36 of rectangular cross-section, and two series of very thin quality hardwood laminates 38 disposed vertically and defining the two wide side surfaces of the handle component. The laminated construction of FIG. 13 tends to be very strong and light-weight but is also extremely expensive to produce. The FIG. 14 shows a different box lamination comprising an arrangement of thick horizontal laminates 40 and side vertical laminates 42 defining the wide side surfaces of the handle component 12.

Thus the material used in making hockey stick handle components 12 are elongated pieces of hardwood of rectangular cross-section having two wide side surfaces and two narrow top and bottom surfaces and normally the four corners have been cut so as to be non-squared off, for example at 45° thus defining very narrow corner flat surfaces between the adjacent main surfaces, and the cross-section of the starting material is constant throughout the length of the piece of hardwood which normally measures about 58 inches i.e. throughout what will finally form the handle and shank, terminating at the heel. Using the basic handle component piece, the successive steps in the making of a hockey stick comprise adding a short block to one narrow surface at one end of the handle component. This block is not shown in its entirely, but the portion thereof remaining in the final hockey stick is designated in FIG. 2 as 44. Once this block has been glued in place, the bottom part of the assembly is provided with a longitudinal slot for receiving the inner end of blade 16 and the assembly is secured together by proper gluing under pressure. Those pieces which will form the blade of the hockey stick, which include in the present case the block and the blade 16 will be referred to as the "lower part". The arrangement is then cut to the proper profile by means of a blade saw or the like followed with a coarse sanding operation designed to taper the shank portion of the handle component i.e. from 22 down to heel position 14 and to also reduce the thickness of blade 16 to about ¼ inch. The entire hockey stick is then submitted to fine sanding, especially the lower portion thereof and it is common to reinforce the heel portion of the hockey stick and sometimes also the entire shank portion and the inner region of blade 16 by winding a thin flexible strip of glass fiber secured in place against the wooden surface of the hockey stick by means of a proper adhesive such as an epoxy glue.

In accordance with this invention, however, the basic piece of hardwood for preparing the handle component 12 comprises at least one shallow groove along each wide side surface of the piece of wood as best seen in FIG. 15. Grooves 50 and 52 which are equally spaced from the opposite top and bottom surfaces 54 and 56 receive an inextensible reinforcement in strip form which are best shown in FIG. 1 at 60 and 62. The reinforcements 60 and 62 closely conform to the shape of their respective grooves 50 and 52 and are glued to the surrounding wood of the handle component 12.

The reinforcing strips 60 and 62 are mounted to the handle component 12 before the construction of the hockey stick structure, namely before installation of the said short block and blade 16. As shown in FIG. 16, a plurality of hockey stick handles 70 are disposed parallel to one another over table 72 on one of their respective narrow sides and are pressed together by means of inwardly urging side members 75 and 76 which maintain an inwardly directed force until substantial curing of the reinforcing strips 78 to the associated piece of hardwood 80. The assembly can be maintained in straight line by means of an upper bar 82 which may be locked in the lower position illustrated in FIG. 16 by rods 84. In practice, each table 72 can receive over twenty hockey stick handles during each curing cycle, and the curing can take place at room temperature when using a suitable epoxy glue.

The basic piece of hardwood used for constructing hockey stick handle components in accordance with this invention can be solid hardwood as shown in FIG. 1 but could also be made of laminated hardwood using for example any of the four designs illustrated in FIGS. 11, 12, 13, and 14. In practice the laminate construction shown in FIG. 11 being a thick vertical hardwood lamination is preferred on account of its low cost and wide availability.

When producing an ice hockey stick in accordance with the present invention, the basic piece of hardwood for making the handle component 12 is first provided with side grooves 50 and 52; the side reinforcing strips 60 and 62 are then glued in place, each strip extending from the upper free end 20 of the handle component 12 and terminating at least a short distance into the shank portion, i.e. beyond the lower region of handle 18 which is illustrated at 22 in FIG. 2, after which the rest of the operations are conventional, namely the addition of a short block, the provision of a slot in the shank portion of the assembly, followed with gluing of the blade component 16 thereinto, shaping of the lower portion of the hockey stick, followed by coarse sanding of the entire lower portion of the hockey stick. The coarse sanding operation which is designed to make the heel and blade portions thinner will also provide a gradual transverse tapering throughout the shank portion 24. Consequently, the lower portions of reinforcing strips 60 and 62 will also gradually taper from the lower region of handle 18 and will completely disappear at some point along shank 24, leaving the lower region of shank 24 without any reinforcement. The absence of reinforcement in the middle and lower region of shank 24 is a very desirable feature in that this lower portion of the hockey stick should be slightly more flexible than the handle 18 in order to absorb some of the shocks which otherwise would be directly transmitted to the arms of the hockey player and also to permit springing back of the blade 16 resulting in faster shooting. The position of the lowest extremity of reinforcing strips 60 and 62 as at 90 in FIG. 2 will be determined by the depth of grooves 50 and 52 in the basic piece of wood used for making the handle, which depth should be constant, and by accurately controlling the coarse sanding operation of the lower region of the hockey The reduction in the thickness of the strips in the shank portion, compared to the handle, can be noted in the figures by comparing the strip thicknesses in FIGS. 4 and 5.

The construction of the hockey stick will be completed by a fine sanding operation followed, if necessary, with wrapping of the lower region of the hockey stick, particularly the heel portion 14 thereof, with a thin and very flexible piece of glass fibre material normally in loosely woven form, and retained in place by a suitable binding, such as an epoxy glue.

Referring now to FIG. 5, which is a cross-section taken along line 5—5 in FIG. 2, we can see that each reinforcing strip 60 or 62 has three of its surfaces in mating engagement with the surrounding wood of the hardwood core 100 and these mating surfaces are glued to the surrounding wood. The fourth surface of each strip, identified by reference numerals 102, 104 are flush with the adjacent margins 104 of the respective side surfaces 106. Consequently, the top and bottom narrow surfaces 108 and 110 and all four corners 112 plus margins 104 on each side surface 106 are wood surfaces and will be felt as such by the hands or gloves of the hockey player giving the impression of an entirely wooden hockey stick handle.

The reinforcing strips 60 and 62 are made of longitudinally extending glass fibre material consisting of continuous strands of textile yarns where glass fibres and graphite fibres are combined and held together as a rigid structure by a suitable binder. Preferably, the glass fibre material will contain between 60% and 70% by weight of glass and graphite fibres, and the preferred binder is epoxy resin. In a preferred embodiment, the graphite fibres are high tensile fibres made from polyacrylonitrile, for example, the graphite yarn sold under the trade mark THORNEL developed by the Union Carbide Corporation in the United States. The reinforcing material should have a tensile strength which is considerably higher than that of the hardwood used as the handle's core 100, and the purpose of the reinforcing strips 60 and 62 is to greatly strengthen the handle portion 18 of a hockey stick without increasing its weight. However, in practice it has been found that the use of embedded reinforcing strips in accordance with this invention will also permit the use of cores made of less than top grade hardwood or hardwood laminates resulting in a very high quality hockey stick produced at comparatively low costs. In effect, the provision of two spaced-apart inextensible strips held together by a core such as at 100 acts in the manner of an I-beam or H-beam when subjected to shooting efforts by the hands of the hockey player.

In FIG. 6 a different embodiment is illustrated by means of a cross-sectional view corresponding to that of FIG. 5. Each reinforcing strip is made of two spaced-apart inextensible components 120 and 122 disposed in respective parallel slightly spaced-apart grooves on each wide surface 130 of core 132.

In FIGS. 7 and 8 the reinforcing strips 140 and 150 are of more compact design and of greater thickness than the strips shown in FIGS. 5 and 6. The reason for using strips of greater depth is, of course, to extend the length of their tapering ends into the middle region of shank portion 24.

In FIG. 9 the reinforcing strips 162 and 164 are disposed into grooves which are deeper than the thickness of strips 162 and 164 and each strip is covered with a very thin layer 166 of wood resulting in a hockey stick handle 12 whose exterior surface is completely free of plastic areas.

In FIG. 10 a different construction is used wherein the central core 170 is thinner than those used in the embodiments illustrated in FIGS. 5 to 9; full width strips of reinforcing material 172 and 174 are deposited in each wide side surface of core 170 by being glued thereto and the outside surface of each reinforcing strip 172 or 174 is covered with a thin layer of wood 176 with the result that the outside surface of the handle component 12 will be completely wood with the exception of narrow strips 178 at each corner.

The embodiments of the invention in which an exclusive property or privilege is claimed are defined as follows:

1. A method of making a handle component for the construction of hockey sticks, comprising the steps of making at least one shallow groove of constant depth in each wide side surface of an elongated piece of hardwood of predetermined constant rectangular cross-section whose four corners are defined by non-squared surfaces with the adjacent surfaces, the arrangement of at least one groove in each wide side surface being located centrally of the associated wide side surface and each groove extending throughout the length of said piece of hardwood, inserting into each of said grooves a preformed strip of resin impregnated undirectional continuous fiber material whose dimensions closely conform to those of said grooves, providing a coating of a suitable adhesive to at least some of the mating groove and strip surfaces, inwardly pressing said strips into their respective grooves and maintaining the pressure until substantial curing of said adhesive, and wherein during the curing step a plurality of stick handles are disposed parallel to one another over a table on one of their narrow sides and pressed together between two inwardly urging side members.

2. A method of making a hockey stick having a handle, a blade and a shank extending from said handle for connecting said blade to said handle, said handle and said shank being integrally formed and defining a handle component, and the lower region of said shank defining the heel portion of said hockey stick, said method comprising:

as a first step, preparing a constant cross-section reinforced handle component by making at least one shallow groove of constant depth in each wide side surface of an elongated piece of hardwood of predetermined constant rectangular cross-section whose four corners are defined by non-squared surfaces joining adjacent surfaces, the arrangement of at least one groove in each wide side surface being located centrally of the associated wide side surface and each groove extending throughout the length of said piece of hardwood, inserting into each of said grooves a preformed strip of resin impregnated unidirectional continuous fiber material whose dimensions closely conform to those of said grooves, and adhering said strips to said grooves, as a second step, forming and permanently securing to the handle component a lower part out of which the blade is to be formed, as a third step cutting the assembly comprising said handle and said lower part to the approximate profile desired, and as a fourth step sanding the lower portion of said assembly for reducing the thickness of the blade to about ¼ of an inch and to taper inwardly the lower portion of said handle component and lower part to define said shank which gradually tapers inwardly from said handle to said heel portion, said sanding step being accurately controlled to progressively remove material from the lower end of said preformed strips to also taper said strips inwardly corresponding to the taper applied to that portion of the shank.

3. A method according to claim 2, wherein said lower part comprises a short block of wood and a bladed component, and said step of forming and securing the lower part comprises gluing said short block of wood to a narrow, longitudinal surface of said handle component at the lower end thereof, cutting a longitudinal slot through said block and handle component for receiving the blade component and permanently securing said blade component into said slot with the block positioned between the blade component and the handle component.

4. A method according to claim 3, wherein said sanding step includes first coarse sanding the lower portion of said assembly and then fine sanding said lower portion of said assembly for obtaining a final desired shape of said shank of said blade and of said heel portion.

5. A method of making a composite hockey stick as defined in claim 4 comprising as a final step winding a thin flexible strip of glass fiber around said heel portion and securing said flexible strip in place by means of a suitable adhesive.

6. A method of making a composite hockey stick as defined in claim 4 comprising as a final step winding a thin flexible strip of glass fiber around at least the inner region of said blade, around said heel portion and around said shank and securing said flexible strip in place by means of a suitable adhesive.

* * * * *